United States Patent [19]

Bersch

[11] Patent Number: 5,060,333

[45] Date of Patent: Oct. 29, 1991

[54] APPARATUS FOR CLEANING PIPELINES FOR BEVERAGES AND THE LIKE WITH A RELIEF VALVE IN THE LIQUID ADMITTING INLET

[76] Inventor: Friedrich Bersch, Industriestrasse 18, D-5401 Halsenbach, Fed. Rep. of Germany

[21] Appl. No.: 468,689

[22] Filed: Jan. 19, 1990

[30] Foreign Application Priority Data

Jan. 23, 1989 [DE] Fed. Rep. of Germany ..... 3901829

[51] Int. Cl.[5] ..... B08B 9/02

[52] U.S. Cl. ..... 15/3.51; 15/104.062; 137/115

[58] Field of Search ..... 15/3.5, 3.51, 104.062; 137/115, 112, 119, 554

[56] References Cited

U.S. PATENT DOCUMENTS

| | | | |
|---|---|---|---|
| 1,165,455 | 12/1915 | Schlemmer | 15/3.51 |
| 1,979,147 | 10/1934 | Dobbelmann | 15/3.51 |
| 2,011,323 | 8/1935 | Remick | 15/3.51 |
| 2,087,414 | 7/1937 | Schoer | 15/3.51 |
| 2,746,250 | 5/1956 | Hawkins | 137/115 |
| 3,633,615 | 1/1972 | Rhodes, Jr. | 137/554 |
| 3,896,280 | 7/1975 | Blake | 137/554 |
| 3,908,688 | 9/1975 | Gandrud | 137/115 |
| 4,403,627 | 9/1983 | Bradley | 137/115 |
| 4,607,410 | 8/1986 | Bersch | 15/3.51 |

FOREIGN PATENT DOCUMENTS

| | | |
|---|---|---|
| 1782136 | 5/1978 | Fed. Rep. of Germany . |
| 3701572 | 4/1988 | Fed. Rep. of Germany . |
| 1207770 | 10/1970 | United Kingdom . |

*Primary Examiner*—Philip R. Coe
*Assistant Examiner*—Gary K. Graham
*Attorney, Agent, or Firm*—Peter K. Kontler

[57] ABSTRACT

Apparatus for cleaning pipelines of finite length with a liquid has a shuttle valve with a body having a liquid admitting inlet, a liquid discharging outlet and two hollow couplings connectable to the ends of a pipeline which requires cleaning. The body confines a shuttle which is reciprocable between two positions in the first of which liquid flows from the inlet to one of the couplings, through the pipeline between the couplings into the other coupling and then into the outlet. When one or more spherical or otherwise configurated cleaning elements in the pipeline cause the shuttle to assume its other position, the liquid flows from the inlet to the other coupling, through the pipeline into the one coupling and then into the outlet. The apparatus and/or the pipeline is likely to be damaged if the pressure at the inlet reaches a certain value and/or when the raised pressure of the liquid causes the shuttle to strike against the body with a greate force as a result of abrupt movement from the one end position to the other end position or in the opposite direction. Therefore, the inlet contains a pressure relief valve which opens and establishes a path for the flow of liquid from the inlet to the outlet around the shuttle when the liquid pressure in or at the inlet reaches or exceeds a preslected value.

16 Claims, 1 Drawing Sheet

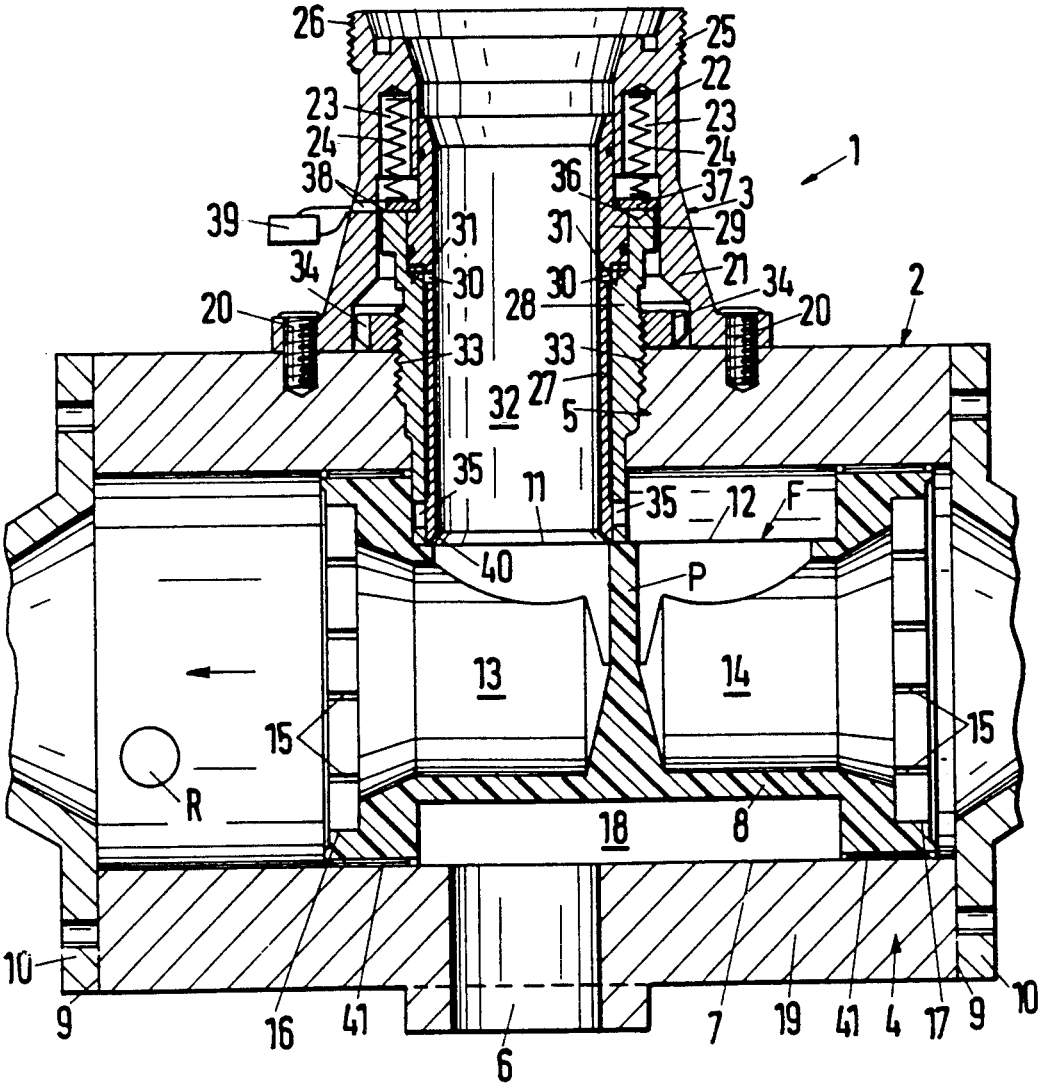
26
25
22
23
23
24
24
1
38
36
37
3
39
31
31
29
34
30
30
21
34
2
20
28
20
33
33
27
32
5
35
11
35
12
F
40
P
13
14
15
15
R
18
8
10
10
9
16
41
6
7
19
41
4
17
9

APPARATUS FOR CLEANING PIPELINES FOR BEVERAGES AND THE LIKE WITH A RELIEF VALVE IN THE LIQUID ADMITTING INLET

BACKGROUND OF THE INVENTION

The invention relates to improvements in apparatus for cleaning pipelines for beverages and the like. More particularly, the invention relates to improvements in apparatus of the type disclosed in commonly owned German Auslegeschrift No. 17 82 136, in commonly owned U.S. Pat. No. 4,607,410 and in commonly owned copending patent application Ser. No. 07/384,208, now U.S. Pat. No. 4,955,100, filed July 21, 1989 for "Apparatus for cleaning pipelines for beverages and the like".

The commonly owned copending patent application, the commonly owned Auslegeschrift and the commonly owned patent disclose an apparatus wherein a shuttle valve is connectable with a source of pressurized liquid and with the ends of a pipeline of finite length to convey a cleaning or rinsing liquid from an inlet, through the pipeline and into an outlet in such a way that the flow of liquid through the pipeline is automatically reversed at predetermined intervals. This is achieved by employing one or more spherical sponge-like or other cleaning elements which are entrained by the liquid flowing through the pipeline to indirectly shift the shuttle in the valve. Apparatus of the just outlined character are used in breweries, vine making establishments, other establishments which produce alcoholic beverages, dairies, soft drink producing plants, many plants of the chemical industry, pubs, bars and for many other purposes.

It has been found that, under certain circumstances, threaded connections and/or other separable connections in the cleaning apparatus and/or in the pipelines become loose in the course of the cleaning operation. Furthermore, it happens that an already defective or partly defective pipe or conduit will break or burst in the course of or as a result of the cleaning operation. The likelihood of loosening separable connections and/or of breaking pipes or conduits is more pronounced when the operation involves the cleaning of large pipelines wherein the cleaning or rinsing liquid (such as water, a caustic solution, an acid or a disinfectant) must be conveyed at an elevated pressure.

OBJECTS OF THE INVENTION

An object of the invention is to provide a novel and improved apparatus for cleaning pipelines for beverages and the like which is less likely to cause loosening of separable connections, such as threaded connections, and/or other damage to a pipeline or to its own component parts in the course of or as a result of a cleaning operation.

Another object of the invention is to provide an apparatus which is constructed and assembled in such a way that the velocity of the shuttle in the shuttle valve can be regulated with any desired degree of accuracy and reproducibility.

A further object of the invention is to provide a novel and improved combination of valves for use in the above outlined apparatus.

An additional object of the invention is to provide an apparatus which is not only unlikely to damage but is actually incapable of damaging a pipeline (even a pipeline wherein the cleaning or rinsing liquid must be conveyed at a relatively high pressure) though its dimensions need not exceed those of a standard apparatus.

Still another object of the invention is to provide a novel and improved method of preventing loosening of threaded and/or other separable connections in pipelines during cleaning or rinsing of such pipelines with a liquid medium.

SUMMARY OF THE INVENTION

The invention is embodied in an apparatus for cleaning with a liquid a pipeline of finite length. The improved apparatus comprises a four-way shuttle valve including a body having a liquid admitting inlet, an outlet and two hollow couplings which are connectable with the ends of a pipeline of finite length. The shuttle valve further comprises a shuttle which is movable in the body between a first position to establish a path for the flow of liquid from the inlet into one of the couplings, through the pipeline between the two couplings, into the other coupling and thence into the outlet, and a second position to establish a path for the flow of liquid from the inlet, into the other coupling, through the pipeline between the couplings, into the one coupling and thence into the outlet. In accordance with a feature of the invention, the apparatus further comprises a pressure relief valve having means for establishing an additional path from the inlet to the outlet in response to a rise of liquid pressure at the inlet above a predetermined value.

The relief valve is or can be connected with the inlet of the body of the shuttle valve. The arrangement is preferably such that the relief valve is at least partially installed in the body of the shuttle valve, preferably in the inlet of the body. The shuttle and the body of the shuttle valve preferably define a chamber which establishes a portion of the additional path and is or can be in permanent communication with the outlet.

The peripheral surface of the shuttle is preferably provided with two ports one of which receives liquid from the inlet in the first position and the other of which receives liquid from the inlet in the second position of the shuttle. The one port serves to admit liquid into the one coupling, and the other port serves to admit liquid into the other coupling. The relief valve preferably includes a tubular (particularly cylindrical) housing which is or can be installed in the inlet to admit liquid into the one port in the first position and to admit liquid into the other port in the second position of the shuttle.

The relief valve preferably further comprises a tubular (particularly a cylindrical) valving element which constitutes or forms part of the aforementioned means for establishing an additional path between the inlet 5 and the outlet 6 and is reciprocable in the housing of the relief valve between an operative position in which the additional path is sealed and an inoperative position in which liquid is free to flow from the inlet into the outlet by way of the additional path. Still, further the relief valve preferably comprises means for yieldably biasing the valving element to the operative position. Such valving element has a surface which is acted upon by liquid in the inlet to move the valving element to the inoperative position against the opposition of the biasing means in response to a rise of liquid pressure in the inlet to or above the predetermined value. The surface of the valving element can include at least one substantially radially extending shoulder on the valving element. The latter can be provided with an external protuberance (e.g., a circumferentially complete or interrupted bead) having a first side which is (directly or indirectly) acted upon by the biasing means and a second side which constitutes or forms part of the aforementioned surface or shoulder. The protuberance can be an integral part of the valving element.

The body of the shuttle valve can include a first portion which comprises the couplings and the outlet, and a second portion which is separably secured to the first portion and includes the inlet. The housing and the valving element of the relief valve are or can be provided in the second portion of the body of the shuttle valve. The biasing means can include a plurality of resilient elements in the form of coil springs which react against the body of the shuttle valve or against the housing of the relief valve and bear upon the one side of the aforementioned protuberance or upon an insert (e.g., a washer) which overlies the one side of the protuberance. The body of the shuttle valve or the housing of the relief valve can be provided with discrete sockets (e.g., in the form of blind bores or holes) for the resilient elements of the biasing means.

A threaded connection can be provided between the body of the shuttle valve and the housing of the relief valve, and a lock nut and/or other suitable means can be provided for releasably holding or locking the housing in a selected position with reference to the body of the shuttle valve.

The aforementioned chamber can constitute an annular recess in the peripheral surface of the shuttle, and the shuttle can be provided with an axially parallel flat at the bottom of the recess. The ports of the shuttle can be provided in the flat.

The apparatus can further comprise impulse generating means for monitoring the positions of the valving element of the relief valve, e.g., to generate an abrupt impulse in response to each movement of the valving element from or to the operative or in operative position.

At least a portion (e.g., the housing and/or the valving element) of the relief valve can be made of an aluminum alloy, particularly a hard-coated aluminum alloy.

The valving element of the relief valve is or can be mounted for reciprocatory movement in directions substantially at right angles to the direction of reciprocatory movement of the shuttle between first and second positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

The single Figure of the drawing is a fragmentary axial sectional view of an apparatus which embodies one form of the invention and wherein the pressure relief valve is installed in the inlet of the body of the shuttle valve, the valving element of the relief valve being shown in the operative position in which the additional path for the flow of liquid from the inlet to the outlet of the body of the shuttle valve is sealed and the shuttle of the shuttle valve being shown in one of its two end positions.

DESCRIPTION OF PREFERRED EMBODIMENTS

The apparatus 1 which is shown in the drawing serves to clean pipelines of finite length by means of a liquid such as water, a caustic solution, an acid or a disinfectant. The apparatus 1 comprises essentially of four-way shuttle valve 2 having a body 4 for and a reciprocable valving element or shuttle 8 resembling a spool, and a pressure relief valve 3 which is installed in a liquid-admitting inlet 5 of the body 4 of the shuttle valve. The body 4 of the shuttle valve 2 includes a first or main portion 19 which confines the shuttle 8 and is provided with an outlet 6 for spent liquid, and a second portion 22 which has a flange 21 separably affixed to the first portion 19 by a set of threaded fasteners 20 or in any other suitable way. The second portion 22 of the body 4 includes the inlet 5 and thus contains at least the major part of the relief valve 3. The housing 4 further comprises two hollow coaxial couplings 10 which are separably or permanently affixed to two spaced-apart end faces 9 of the first portion 19 and are separably connectable to the ends of a pipeline of finite length, e.g., a pipeline of the type shown in FIG. 1 of the commonly owned German Auslegeschrift No. 17 82 136 or in FIG. 5 of commonly owned U.S. Pat. No. 4,607,410. The disclosure of U.S. Pat. No. 4,607,410 is incorporated herein by reference. The separable connections between the couplings 10 and the respective ends of a pipeline can be of the type shown in FIG. 1 of the aforementioned Auslegeschrift.

The peripheral surface 41 of the shuttle 8 and the internal surface 7 of the substantially cylindrical first portion 19 of the housing 4 define an annular chamber 18 which is in permanent communication with the outlet 6 and is actually a recess in the peripheral surface 41 of the shuttle so that the latter resembles a spool or reel with two flanges flanking the recess or chamber 18. The bottom surface in the recess 18 includes a flat F which is or can be parallel with the axis of the shuttle 8 and is provided with two axially spaced-apart ports 11, 12 which respectively communicate with two internal channels or compartments 13, 14 of the shuttle. The latter has a partition P between the ports 11, 12 and the compartments 13, 14. The compartment 13 extends to one axial end 16 and the compartment 14 extends to the other axial end 17 of the shuttle 8. Each of the axial ends 16, 17 is provided with an array of openings 15 which establish communication between the respective compartment 13, 14 and the interior of the adjacent hollow coupling 10.

The pipeline to be cleaned contains a set of spherical and/or otherwise configurated cleaning elements R (one shown in the drawing) which can enter the first portion 19 of the body 4 by way of the hollow couplings 10 and can gather at the axial end 16 or 17 to at least substantially seal the respective array of openings 15. The drawing shows the shuttle 8 in one of its end positions in which the inlet 5 can admit pressurized liquid into the port 11, and such liquid is free to flow along an elongated first path defined by the compartment 13, openings 15 at the end 16 of the shuttle 8, the left-hand part of the first portion 19 of the body 4, the left-hand coupling 10, the pipeline the ends of which are connected to the couplings 10, the right-hand coupling 10, the openings 15 at the right-hand end 17 of the shuttle 8, the compartment 14, the port 12 and the chamber or recess 18 (which latter communicates with the outlet 6).

The end 17 of the shuttle 8 intercepts the cleaning elements R which are conveyed by the liquid from the left-hand part of the first body portion 19, through the pipeline and into the right-hand coupling 10 whereby such cleaning elements at least partially seal the openings 15 in the right-hand end 17 of the shuttle 8. This results in a rise of liquid pressure in the right-hand coupling 10 with the result that the shuttle 8 is automatically shifted to its left-hand end position in which the inlet 5 is free to admit pressurized liquid into the right-hand port 12. The thus admitted liquid then flows along a second path extending from the port 12, through the compartment 14, the right-hand openings 15 (to expel the cleaning elements R from the end 17 of the shuttle), the right-hand coupling 10, the pipeline between the two couplings, the left-hand coupling 10, the openings 15 in the left-hand end 16 of the shuttle 8, the compartment 13, the port 11 and the chamber or recess 18 (which communicates with the outlet 6). When the cleaning elements R gather at the left-hand end 16 of the shuttle 8, they block at least some of the corresponding openings 15 to cause the pressure of the conveyed liquid to rise whereby the shuttle 8 moves back to the illustrated end position and the liquid is again free to flow along the first path (via port 11) on toward and through the pipeline on its way into the outlet 6.

The back-and-forth movements of the shuttle 8 in the first portion 19 of the body 4 are terminated when the pump (not shown) or another suitable source of pressurized liquid ceases to deliver liquid to the inlet 5. The cleaning elements R can constitute small spheres and/or otherwise configurated bodies of foam rubber or another material. All that counts is to ensure that pressurized liquid which is admitted via inlet 5 can entrain the cleaning elements R through the pipeline between the couplings 10 and that such cleaning elements cannot penetrate through the openings 15 at the end 16 or 17 of the shuttle 8.

It has been found that the pipeline and/or the shuttle valve 2 is likely to be damaged or even destroyed and/or to develop leaks as a result of repeated pronounced impact of the shuttle 8 against the one or the other coupling 10 and/or as a result of excessive buildup of liquid pressure in the inlet 5 during movement of the shuttle to the one or the other end position, i.e., during that stage of operation of the improved apparatus 1 when the cleaning elements R are urged against the end 16 or 17 of the shuttle. The purpose of the relief valve 3 is to establish an additional and practically direct path for the flow of liquid from the inlet 5 into the outlet 6 as soon as the pressure of liquid in the inlet 5 rises above a predetermined value. To this end, the valve 3 comprises a reciprocable tubular valving element 27 which constitutes a means for establishing or opening the additional path between the inlet 5 and the outlet 6 as soon as the need arises, i.e., automatically in response to a rise of liquid pressure in or at the inlet 5 above the predetermined value. The illustrated valving element 27 is reciprocable in a tubular housing 28 of the relief valve 3 at right angles to the direction of reciprocatory movement of the shuttle 8 in the first portion 19 of the body 4 of the shuttle valve 2. The tubular housing 28 has an external thread mating with an internal thread of the body portion 19 to establish therewith a threaded connection 33 while the inner end portion of the housing 28 extends well into the annular chamber or recess 18 and close to the flat F of the shuttle 8. The housing 28 is then locked or fixed in selected axial position by a lock nut 34 which is confined in an internal space of the flange 21 forming part of the second portion 22 of the body 4.

The radially outermost part 25 of the second portion 22 of the body 4 has a set of preferably equidistant axially parallel internal sockets 23 in the form of blind bores or holes each of which receives a discrete resilient element 24 in the form of a coil spring. These coil springs constitute a means for yieldably biasing the valving element 27 of the relief valve 3 to the illustrated operative position in which the valving element seals the additional path between the inlet 5 and the outlet 6. The radially outermost part 25 of the second portion 22 of the body 4 is further provided with external threads 26 receivable in and detachable from the internally threaded end portion of a conduit (not shown) which serves to convey pressurized cleaning or rinsing liquid from a pump or another source into the inlet 5, namely into the interior 32 of the valving element 27.

The valving element 27 is provided with an external protuberance 29 in the form of a circumferentially complete or interrupted annular bead having an upper side 36 which is directly or indirectly acted upon by the adjacent end convolutions of the coil springs 24, and a second side or surface 31 which is a radial shoulder and is acted upon by liquid in the interior 32 of the valving element 27. To this end, the tubular wall of the valving element 27 has one or more apertures 30 (e.g., in the form of small circular bores or holes) which ensure that the pressure at the shoulder 31 matches the pressure in the inlet 5. Once such pressure rises above the predetermined value, the valving element 27 is shifted in the housing 28 against the opposition of the springs 24 and opens the additional path for the flow of liquid substantially directly from the interior 32 of the valving element 27 into the outlet 6. Such additional path is established by one or more relatively large openings or ports 35 in the radially innermost portion of the housing 28, the port 11 or 12 of the shuttle 8, the compartment 13 or 14 of the shuttle, and the chamber or recess 18. Thus, the stream of liquid leaving the inlet 5 by flowing along the additional path need not pass through the openings 15, couplings 10 and the pipeline between the couplings.

The liquid which fills the interior 32 of the valving element 27 can also act upon the inner end face 40 of this valving element in order to assist the liquid acting upon the shoulder 31 to move the valving element radially outwardly against the opposition of the springs 24 and to thus establish or open the additional path in practically immediate response to a rise of liquid pressure above a predetermined value.

When the pressure of liquid in the inlet 5 drops to a value at which the liquid is not likely to overly stress the shuttle valve 2 and/or the pipeline between the couplings 10, the springs 24 are free to expand and to return the valving element 27 to the illustrated operative position in which the radially innermost portion of the valving element seals or at least substantially seals the openings or ports 35 from the inlet 5. It is clear that the valving element 27 can also comprise one or more openings or ports at its end face 40 to move such openings or ports into partial or full register with the openings or ports 35 as soon as the pressure in the inlet 5 reaches or exceeds the predetermined value.

The upper side 36 of the protuberance or bead 29 at the outer end of the valving element 27 abuts a washer-like insert 37 which is directly acted upon by the coil springs 24 and is reciprocable in the housing 28. The springs 24 are properly stressed as soon as the threaded fasteners 20 are applied to properly attach the flange 21 of the second portion 22 to the first portion 19 of the body 4 of the shuttle valve 2.

The illustrated apparatus 1 further comprises a composite impulse generating device including a detector 38 which is adjacent the path of movement of the insert or washer 37 in the body portion 22 and an impulse processing unit 39 which records and/or signals the frequency of movement of the valving element 27 to and/or from its operative or inoperative position. The detector 38 can form an integral part of the impulse processing unit 39. The arrangement may be such that the detector 38 is mounted in the portion 22 of the body 4 and the unit 39 is installed externally of the portion 39. However, and as shown in the drawing, the detector 38 can be connected with a remote unit 39 by one or more electrical conductors. It is also possible to mount the unit 39 and/or the detector 38 on the housing 28 of the relief valve 3. The detector 38 can constitute a contact-free proximity detector of any known design, e.g., an optoelectronic, magnetic, electronic or inductive proximity detector. However, it is equally possible to employ a detector which is mechanically connected with the insert 37 and/or with the reciprocable valving element 27.

The operation of the improved apparatus 1 will be readily understood upon perusal of the preceding description of the drawing. As mentioned above, the stream of pressurized liquid which is admitted via inlet 5 flows into the port 11 or 12 (depending upon the momentary position of the shuttle 8) and is caused to flow through the pipeline from the left-hand coupling 10 toward and into the right-hand coupling or in the opposite direction to thereupon flow through the compartment 13 or 14, the corresponding port in the flat F and into the outlet 6 by way of the chamber or recess 18. If the liquid is water, the outlet 6 can be connected with a drain. If the liquid is a caustic or acid medium or a disinfectant which should not be discharged into the drain, the outlet 6 discharges into a collecting receptacle which, in turn, can convey used liquid to a regenerator or to a cleaning unit prior to readmission into the inlet 5.

The radially innermost portion of the housing 28 constitutes an abutment or stop which limits the extent of axial movability of the shuttle 8 between its end positions in which the inner end of the valving element 27 registers with the port 11 or 12.

The relief valve 3 is caused to establish the aforementioned additional path via openings or ports 35 and annular chamber or recess 18 only when the pressure of liquid in the inlet 5 (i.e., in the interior 32 of the valving element 27) rises above the predetermined value. The pressurized liquid then lifts the valving element 27 in the housing 28 and stresses the coil springs 24 as long as is necessary to ensure that the pressure of liquid drops to an acceptable value. The impulse generating device 38, 39 generates, records and preferably displays a signal or impulse denoting that the valving element 28 has been caused to leave its operative position as a result of excessive rise of liquid pressure in the inlet 5. The person in charge can decide whether or not an inspection and/or any other undertaking is necessary by ascertaining the frequency of movement of the valving element 27 to its inoperative position.

The valving element 27 automatically reassumes the illustrated operative position as soon as the pressure of liquid in the inlet 5 does not suffice to overcome the energy which is stored in the springs 24. This closes or seals the additional path, and the admitted pressurized liquid again flows through the port 11 or 12 on its way into and through the pipeline between the couplings 10. The relief valve 3 can be actuated by liquid at excessive pressure in the inlet 5 irrespective of the momentary axial position of the shuttle 8. Moreover, the relief valve 3 can (but need not) open the additional path between the inlet 5 and the outlet 6 each time the shuttle 8 is about the move or is in the process of moving or has completed its movement to the one or the other end position. This softens the impact of the one or the other flange of the shuttle 8 against the radially innermost portion of the housing 28, i.e., the transition from one end position to the other end position of the shuttle is smoother and softer than heretofore.

An advantage of the feature that the relief valve 3 is installed in the inlet 5, i.e., that the relief valve is actually incorporated into the shuttle valve 2, in that the addition of the relief valve does not affect the compactness of the apparatus 1. The relief valve 3 can be installed in the portions 19 and 22 of the body 4 of the shuttle valve 2 at the plant wherein the improved apparatus is assembled so that the apparatus is ready for immediate utilization without the need for assembly at the locus of use. All that is necessary to start a cleaning operation is to connect the ends of a pipeline with the coupling 10 and to connect the externally threaded (at 26) outermost part 25 of the body portion 22 with the discharge end of a conduit which supplies pressurized cleaning or rinsing liquid.

While it is equally within the purview of the invention to provide a separate bypass to establish an additional path for the flow of liquid from the inlet 5 to the outlet 6 when the pressure of liquid in the inlet exceeds an acceptable value, the illustrated means for establishing the additional path (including the housing 28 with its ports 35 and the shuttle 8 with its ports 11, 12, compartments 13, 14 and recess or chamber 18) is preferred at this time because it contributes to compactness of the apparatus by the simple expedient of using the shuttle 8 as a means for establishing a substantial part of the additional path to thus ensure rapid and reliable reduction of liquid pressure in the inlet 5 at a time when elevated liquid pressure could cause extensive damage to the apparatus and/or to the pipeline.

It is further possible to employ the couplings 10 as a means for arresting the shuttle 8 in the respective end positions. The illustrated design (wherein the housing 28 of the relief valve 3 serves as a stop for the shuttle 8 is preferred at this time because the port 11 or 12 is more likely to remain in a position of accurate register with the inner end portion of the valving element 27. If desired, a radially inwardly projecting extension of the body portion 22 can serve as an abutment or stop in lieu of or in addition to the radially innermost portion of the housing 28, i.e., of a component part of the relief valve 3.

It is further possible to mount the housing 28 in the interior of the valving element 27 without departing from the spirit of the invention.

The cross-sectional area of the additional path can be readily selected in such a way that, in conjunction with certain other parameters (such as the friction between the valving element 27 and the housing 28, the weight or mass of the valving element 27 and/or the effective area of the end face 40 and shoulder 31), the pressure of liquid acting upon the end face 40 and the shoulder 31 just suffices to overcome the resistance or opposition of the springs 24 as soon as the pressure in the inlet 5 rises to a value which could result in damage to the apparatus 1 and/or to the pipeline. The reduction of pressure in the inlet 5 as a result of the establishment of an additional path by way of the port or ports 35, coupled with friction between the flanges of the shuttle 8 and the internal surface of the first or main portion 19 of the body 4, should be sufficient to ensure that the shuttle moves from the one to the other end position at a speed which is not likely to result in very pronounced impact of the one or the other flange of the shuttle against the inner end portion of the housing 28. The cross-sectional areas of the flanges at the ends 16, 17 of the shuttle 8 and the mass of the shuttle also influence the rate of speed at which the shuttle is moved from the one to the other end position or in the opposite direction.

The sockets 23 for the coil springs 24 can be provided inwardly of the protuberance 29, i.e., the coil springs 24 can serve to bias the valving element 27 away from the shuttle 8 if the relief valve 3 is designed in such a way that pressurized liquid in the inlet 5 acts upon the side 36 of the valving element toward an inoperative position in which the thus displaced valving element opens the additional path for the flow of pressurized liquid practically or nearly directly from the inlet 5 into the outlet 6.

The placing of the entire relief valve 3 into the second portion 22 of the body 4 ensures that the relief valve is adequately shielded against damage during transport. Nevertheless, the parts of the relief valve 3 are readily accessible as soon as the threaded fastening elements 20 are removed or loosened to permit detachment of the second portion 22 from the first portion 19 of the body 4. An existing apparatus can be readily converted for use with the relief valve 3 or with an equivalent or analogous relief valve by the simple expedient of providing the body of an existing four-way shuttle valve with a radial bore for the housing 35 and installing the portion 22 on the thus modified body of the existing shuttle valve.

The exact pressure at which the relief valve 3 responds to open the additional path between the inlet 5 and the outlet 6 can be selected with a high degree of accuracy, for example, by replacing the illustrated coil springs 24 with stronger or weaker springs and/or by moving the flange 21 of the body portion 22 further away from or nearer to the shuttle 8, i.e., by permitting the installed springs 24 to dissipate some energy or to store additional energy in the operative position of the valving element 27. Still further, the bias of the springs 24 can be altered by placing suitable inserts into or by removing such inserts from the respective sockets 23. The illustrated coil springs 24 can be replaced by, or used jointly with, other types of springs, e.g., with packages of dished springs.

The annular insert 37 constitutes an optional element of the relief valve 3. The purpose of this insert is to be maintained in a large-area contact with the adjacent side 36 of the protuberance 29. This results in a more uniform distribution of forces which are applied to the insert 37 by the springs 24. Moreover, the insert 37 renders it possible to employ coil springs having diameters larger than the width (radial dimension) of the side 36 of the protuberance 29. Still further, the insert 37 centers the valving element 27 in its housing 28 and/or relative to the second portion 22 of the body 4 so that the portion 22, the element 27 and/or the housing 28 need not be machined or finished with a very high degree of precision. This contributes to a lower cost of the relief valve, of the portion 22 of the body 4 and of the entire apparatus.

The housing 28 of the relief valve 3 can be more or less permanently installed in the portion 19 or 22 of the body 4. The illustrated threaded connection 33 is preferred at this time because it renders it possible to readily detach the housing 28 from the portion 19 of the body 4 and/or to accurately select the axial position of the housing at an optimum distance from the flat F of the shuttle 8. The threaded connection 33 renders it possible to select the axial position of the housing 28 in such a way that the inner end face of the properly adjusted housing 28 is maintained in very close or immediate proximity to the flat F so that cleaning liquid flowing from the inlet 5 into the port 11 or 12 cannot spill into the adjacent portion of the chamber or recess 18. The nut 34 serves to reliably lock the housing 28 in the selected axial position. The provision of the flat F greatly reduces the likelihood of leakage of liquid which is supposed to flow from the inlet 5 into the outlet 11 or 12, depending on the momentary axial position of the shuttle 8.

The impulse generating means 38, 39 constitutes an optional but highly desirable and advantageous feature of the improved apparatus. The unit 39 can include a standard counter or a more sophisticated counter, and this unit can be connected with or can embody a suitable display for the signals or impulses which are generated whenever the valving element 27 of the relief valve 3 moves to or away from the illustrated operative position or to or from the inoperative position. For example, and as already mentioned above, the valving element 27 can be caused to leave its operative position in response to each change of axial position of the shuttle 8. This enables the unit 39 to indicate the number of reversals in the flow of cleaning or rinsing liquid through the pipeline between the couplings 10 and hence the momentary stage of the cleaning operation. Consequently, the operator in charge or an automatic shutoff system can terminate the cleaning or rinsing operation as soon as the pipeline has undergone the required or desired cleaning treatment. This reduces the energy requirements of the apparatus and ensures that no liquid is wasted for unnecessary conveying through the pipeline and into the outlet 6.

At least certain parts (such as the housing 28 and/or the valving element 27) can be made of a suitable alloy, particularly a hard-coated aluminum alloy. Such lightweight materials are preferred at this time because they can stand the necessary pressures and do not contribute to excessive bulk or mass or weight of the relief valve.

A relief valve which is somewhat similar to the relief valve 3 is disclosed in German Offenlegungsschrift No. 37 01 572 of Pedersen. The valve of Pedersen is intended for use in hydraulic control circuits, steering systems and power transmitting apparatus.

British Pat. No. 1 207 770 to Hinz discloses a device which serves to move a pig or scraper through a pipeline by means of pressurized gaseous fluid. The apparatus which is shown in FIG. 1 of the patent employs a one-piece shuttle and a mechanical damper which yieldably opposes axial movement of the shuttle to one of its end positions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for cleaning with a liquid and at least one cleaning element a pipeline of finite length, comprising a four-way shuttle valve including a body having a liquid admitting inlet, an outlet and two hollow couplings connectable to the ends of a pipeline of finite length, and a shuttle movable in said body in response to movement of said at least one cleaning element between a first position to establish a path for the flow of liquid from said inlet into one of said couplings, through the pipeline between said couplings, the other coupling and into said outlet, and a second position to establish a path for the flow of liquid from said inlet into said other coupling, through the pipeline between said couplings, through said one coupling and into said outlet; and a pressure relief valve installed in said inlet and having means for establishing a first portion of an additional path from said inlet to said outlet in response to a rise of liquid pressure in said inlet above a predetermined value, said shuttle and said body defining a chamber which establishes a second portion of said additional path and communicates with said outlet, said relief valve comprising a tubular housing in said inlet and means for establishing said first portion of said additional path comprising a tubular valving element which is reciprocable in said housing between an operative position in which said additional path is sealed and an inoperative position in which liquid is free to flow from said inlet into said outlet by way of said additional path.

2. The apparatus of claim 1, wherein said shuttle has a peripheral surface with two ports one of which receives liquid from said inlet in the first position and the other of which receives liquid from the inlet in the second position of said shuttle, said one port being arranged to admit liquid into said one coupling and said other port being arranged to admit liquid into said other coupling.

3. The apparatus of claim 2, wherein said housing admits liquid into said one port in the first position and into said other port in the second position of said shuttle.

4. The apparatus of claim 1, wherein said relief valve further comprises means for yieldably biasing said valving element to said operative position, said valving element having a surface which is acted upon by liquid in said inlet to move the valving element to said inoperative position against the opposition of said biasing means in response to a rise of liquid pressure in said inlet above said predetermined value.

5. The apparatus of claim 4, wherein said surface includes a substantially radially disposed shoulder on said valving element.

6. The apparatus of claim 4, wherein said valving element has an external protuberance having a first side which is acted upon by said biasing means and a second side constituting or forming part of said surface.

7. The apparatus of claim 6, wherein said protuberance is a substantially annular bead forming an integral part of said valving element.

8. The apparatus of claim 1, wherein said body includes a first portion comprising said couplings and said outlet and a second portion separably connected with said first portion and including said inlet, said tubular housing and said valving element being provided in said second portion of said body.

9. The apparatus of claim 1, wherein said relief valve further comprises a plurality of coil springs reacting against said body and bearing against said valving element to yieldably bias said valving element to said operative position, said housing having sockets for said coil springs.

10. The apparatus of claim 1, wherein said valving element has an external protuberance having a first side and a second side, said relief valve further comprising an insert adjacent one of said sides and resilient means reacting against said housing and bearing upon said insert to yieldably bias said valving element to said operative position, the liquid in said inlet acting upon the other of said sides to move said valving element to inoperative position against the opposition of said resilient means when the pressure of liquid in said inlet rises above said predetermined value.

11. The apparatus of claim 1, further comprising a threaded connection between said housing and said inlet and means for locking the housing to said body in a selected position.

12. The apparatus of claim 1, wherein said shuttle has a peripheral surface and said chamber is formed by a recess in said peripheral surface.

13. The apparatus of claim 12, wherein said recess is an annular recess, said shuttle further having a flat in said recess and two ports in said flat, one of said ports receiving liquid from said inlet in the first position and the other of said ports receiving liquid from said inlet in the second position of said shuttle, said one port being arranged to admit liquid into said one coupling and said other port being arranged to admit liquid into said other coupling.

14. The apparatus of claim 1, further comprising impulse generating means for monitoring the positions of said valving element.

15. The apparatus of claim 1, wherein at least a portion of said relief valve consists of an aluminum alloy, particularly a hard-coated aluminum alloy.

16. The apparatus of claim 1, wherein said shuttle is reciprocable in said body in a first direction and said means for establishing said additional path comprises a valving element which is reciprocable in said inlet in a second direction substantially at right angles to said first direction.

* * * * *